United States Patent [19]

Kao

[11] Patent Number: 4,748,698

[45] Date of Patent: Jun. 7, 1988

[54] STOOL COVER WITH SMELL ELIMINATOR

[76] Inventor: Chun-Hsien Kao, 4F., No. 11, Lane 223, Cheng-Kung Rd., Sec. 4, Nei-Hu-Chu, Taipei, Taiwan

[21] Appl. No.: 943,204

[22] Filed: Dec. 15, 1986

[51] Int. Cl.[4] ..... E03D 9/04

[52] U.S. Cl. ..... 4/217; 4/213

[58] Field of Search ..... 4/217, 209 R, 213

[56] References Cited

U.S. PATENT DOCUMENTS

| | | | |
|---|---|---|---|
| 532,977 | 1/1895 | Mahoney | 4/217 |
| 759,473 | 5/1904 | Rousseau | 4/217 |
| 1,247,176 | 11/1917 | Swarzman | 4/217 |
| 1,794,635 | 3/1931 | Mills | 4/217 |
| 3,533,112 | 10/1970 | Poister | 4/217 |
| 3,953,901 | 5/1976 | Poister et al. | 4/217 |
| 3,999,225 | 12/1976 | Ables | 4/217 |
| 4,118,341 | 10/1978 | Ishibashi et al. . | |
| 4,251,888 | 2/1981 | Turner | 4/217 |

FOREIGN PATENT DOCUMENTS

| | | | |
|---|---|---|---|
| 919354 | 1/1973 | Canada | 4/213 |

*Primary Examiner*—Mark J. Thronson
*Assistant Examiner*—L. J. Peters
*Attorney, Agent, or Firm*—Browdy and Neimark

[57] ABSTRACT

A new type of stool cover had an air tight and hollow inside part of its seat-ring, with bottom that is fitted with drafting openings with fittings to plug up the openings. A plug system involves a support, a spring, a plug support, and a filler associated with each draft opening in the bottom of the seat-ring. The plug support and the filler are made of one piece. While the user is sitting on the seat-ring, the plug support moves upward against the spring, in turn moving the filler away from the drafting opening. The drafting openings are then just opened, and draft from their location on top of the stool. The bad smell produced in the stool can thus continually be avoided.

6 Claims, 3 Drawing Sheets

STOOL COVER WITH SMELL ELIMINATOR

FIELD OF THE INVENTION

A new type of stool cover mainly comprises a seat-ring featured to be hollow inside with its bottom fitted with air drafting openings and a micro switch. The circumference of the seat-ring is fitted with a pipe, for connection to a bad smell eliminator by a draft effect. While the stool is being used, any bad smell is eliminated without any perception thereof.

BACKGROUND OF THE INVENTION

No one likes to use the bathroom right after another guy, because it is full of bad smell. It takes a tiresome period of time waiting for fresh air again in the bathroom. What a terrible waiting.

Nowadays, a bathroom is always fitted with a ventilating system on the ceiling or with other known means, but this does not get rid of the bad smells right away. Though the government of the Republic of China has approved of a kind flush toilet which is regarded as able to take away the bad smell (by official document No: 6222256), as a patented article with its necessary fittings, yet it works inside of the water tank, involving drafting openings, a drafting chamber, and the flush stool together formed into a ventilating system with the drafter, by the drafter's driving power sending the bad smell from the stool to the outside of the building. This kind of flush toilet operates by a spring for switching the power on and off. The bad smell being sent outside of the building pollutes in the community of a housing area. On the other hand, this kind of structure would never be able to eliminate the bad smell completely.

OBJECTS OF THE INVENTION

The purpose of this invention is to collect all the bad smell that is output into the eliminator to be completely absorbed active matter, and to provide fragrance as well.

SUMMARY OF THE INVENTION

A new type of stool cover lies on the seat-ring featured hollow inside with its bottom fitted air drafting openings and micro switch. The ring circumference is fitted with a drafting pipe. The pipe is directly coupled with a bad smell eliminator and a fragrance tank to get rid of the bad smell with active matter and to give off a sweet smell by the fragrance. Once the user is sitting on the seat-ring, the micro switch will automatically turn on the motor for active matter the fragrant matter giving off the sweet smell. All the bad smell is completely eliminated while the fragrant smell is provided for all its good effects.

SPECIFIC DESCRIPTION

Figure 1:
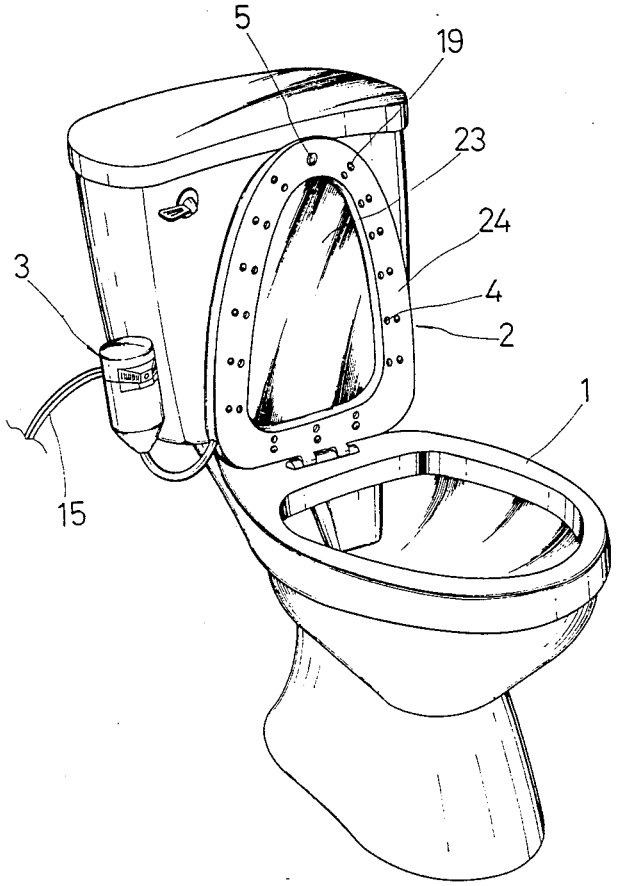
FIG. 1 indicates an embodiment of invention.

As shown in FIG. 1, the invention is located on top of stool 1. It consists of mainly the stool cover 2, the bad smell eliminator 3, air drafting openings 4, plug-in fittings 4A, and micro switch 5 as well. Stool cover 2 consists of cover board 23 and seat-ring 24. Cover board 23 is similar to the typical one, so that it is not necessary to give any more explanation in detail. Seat-ring 24 has an air tight hollowed-out inside and is made from physically solid matter, and its bottom is fitted with a micro switch 5 for making electricity conduction in wires 14 from power supply 15.

Figure 2:
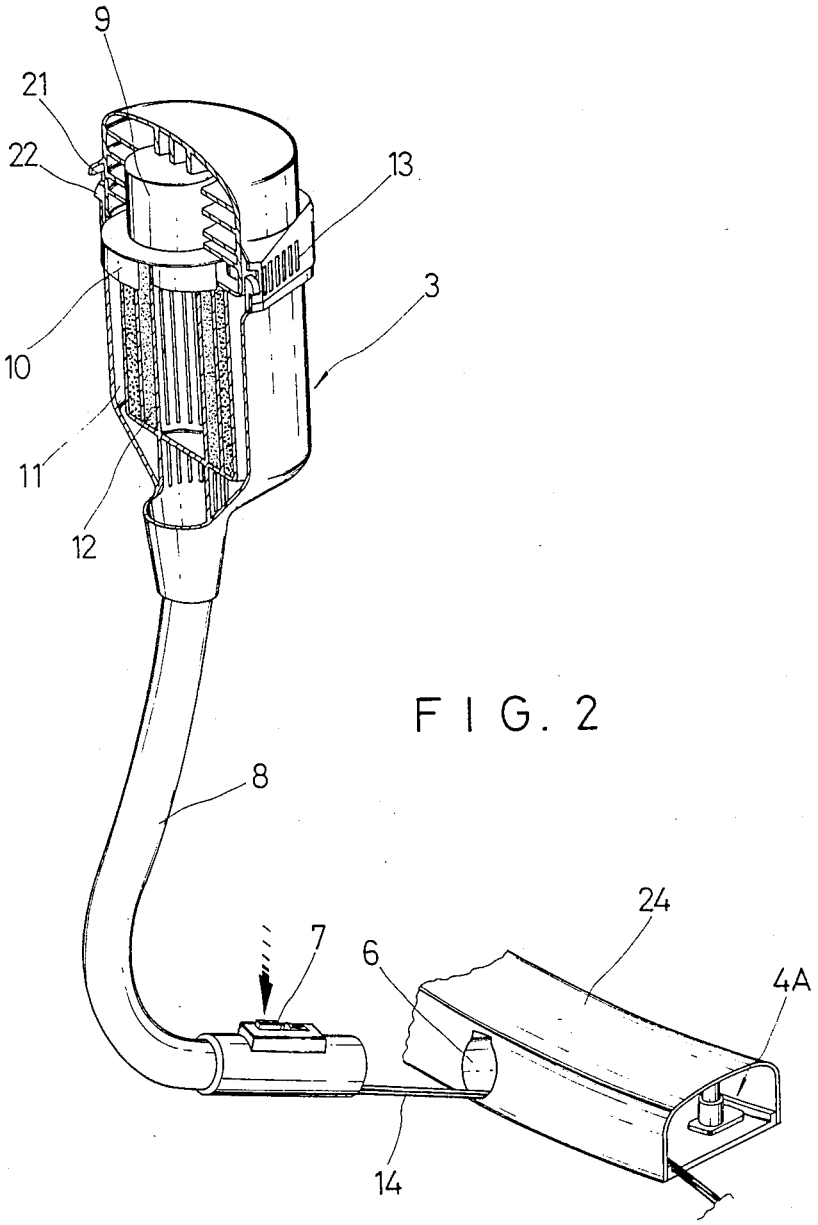
FIG. 2 shows the structure in a simple way.
Figure 4:
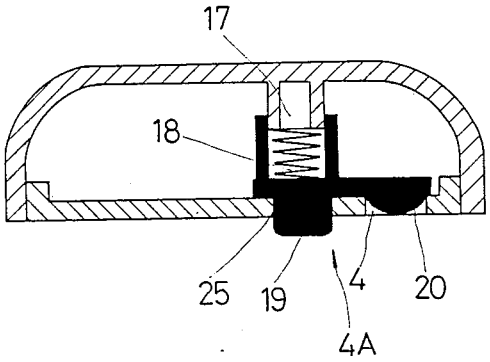
FIG. 4 shows how the mechanism works for this invention.

The inside circumference of the seat-ring 24 of this new stool cover 2 is fitted with air drafting openings 4 (as shown in FIG. 1). These air drafting openings 4 are each fitted with a plug 4A separately and respectively inside the seat-ring 24 as shown in FIG. 2 and FIG. 4. It consists of a spring 18, plug 19, plug support 17, and the filler 20 as well as the opening 25. Plug 19 and filler 20 are made of one piece. It looks roughly like a "T" turned counter clockwise by 90°, which is held in the seat-ring. Plug 19 with its lower end goes through the opening 25, with its one piece filler 20 plugs up the opening 4. It also makes use of the spring 18 staying in place, and thus enables the drafting openings 25 to be closed. This assures there is no chance of insects going in while flushing. When the user is sitting on the seat-ring 24, the bodily weight will make the plug support smaller, and at the same time makes the filler 20 open the air drafting openings 4 for taking away the bad smell in the stool 1. The inside circumference of seat-ring 24 is smaller than the inside circumference of the stool 1. While the seat-ring 24 lies on stool 1, the air drafting openings 4 are just exposed above the top of the stool. The stool cover board 1 thus has no change to block the air drafting openings. Thus bad smell in the stool 1 can be drafted away continually.

Figure 3:
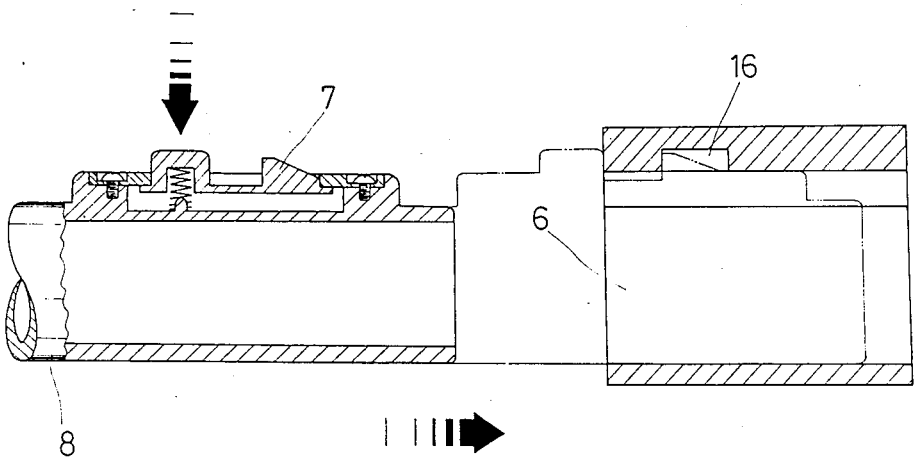
FIG. 3 shows an enlargement of the joining parts.

On the outside of the circumference of the seat-ring 24, there is fitted a coupling opening 6. The side of the opening has an appropriate thickness. The inside of the opening is fitted with a holding tank 16 which is connected with drafting peg 7 of the drafting pipe 8 (refer to FIG. 3). For the convenience of cleaning, the drafting pipe 8 has its other end connected with the bad smell eliminator 3. The bad smell eliminator can be fitted at any proper location near by the stool in the bathroom. The top of the bad smell eliminator 3 is fitted with a drafter motor 9 and drafting fan 10. The lower side of the bad smell eliminator 3 is fitted with active matter 11 and fragrant matter 12. The bad smell eliminator 3 is provided with the peg 22 and holding recess 21 for the convenience of refilling active carbon 11 and fragrant matter 12. There are air ventilating openings 13 fitted around. Active carbon 11 and fragrant matter 12 can be provided in the form of layers. When the user is sitting on the stool cover 2, the micro switch 5 connects the power via wires 14 (see FIG. 2), the motor 9 starts going, drafting fan 10 then starts working, and the bad smell is driven into the bad smell eliminator 3. By means of the active matter in the eliminator 3, the bad smell is completely absorbed. By means of the fragrant matter 12, the air going through opening 13 allows the user to smell the fragrance. There is no bad smell that leaves in the bathroom. On the other hand, when people are finished washing in the bathroom, the micro switch 5 will cut off the power automatically, and then the motor 9 will naturally stop. Thereby bad smell will be eliminated automatically.

The air, after passing through the active matter 11 and fragrant matter 12, can be returned to the seat-ring 24 for discharge from ventilating openings in an outside circumference of the bottom of the seat-ring, similar to the intake ventilating openings 4 shown in FIG. 1.

I claim:

1. A stool cover adapted to be pivotally mounted on a toilet stool having a peripheral rim, comprising:

a hollow seat-ring having a bottom fitted with a microswitch, an inside circumference of said bottom having air drafting openings communicating with the hollow interior of said seat-ring, and an outside circumference of the seat-ring having a coupling opening communicating with the hollow interior of said seat ring;

a drafting pipe connected at a first end thereof with the hollow interior of said seat-ring via said coupling opening;

ventilating means, including a bad smell eliminator, connected to a second end of said drafting pipe; and opening means provided in said seat-ring for allowing air to flow through said drafting openings when a user is sitting on said seat-ring, said opening means comprising plugs, extending through respective further openings in the bottom of said seat-ring said plugs extending from said bottom of said seat-ring and being adapted to lie engaged by the rim of the toilet stool when a user is sitting on said seat-ring, spring means for biasing said plugs out through said further openings; and blocking means extending from each said plug for blocking the respective drafting opening when a user is not sitting on said seat-ring, wherein said drafting openings are opened and said microswitch is actuated whenever a user is sitting on said seat-ring to activate said ventilating means to eliminate any bad smell.

2. The cover of claim 1, wherein said seat-ring is wider than a top of the stool so that said inside circumference extends inside said top so that when a user is sitting on said seat-ring there is no obstacle for the operation of said drafting openings.

3. The cover of claim 1, wherein said ventilating means comprises:

a drafting motor with a fan at a top part of said ventilating means; and containers for active matter and fragrant matter, wherein the outside circumference of said ventilating means is fitted with ventilating openings, whereby fragrant smell is given off while any bad smell is eliminated.

4. The device of claim 1, each said plug and blocking means being formed of one piece to roughly resemble a "T" rotated 90°.

5. The device of claim 1, wherein the opening of said drafting holes by movement of the plug and blocking means occurs mechanically as a result of the user sitting down on the seat-ring.

6. The device of claim 1, wherein opening of the drafting holes occurs mechanically as a result of the user sitting down on the seat-ring.

* * * * *